US005720670A

United States Patent [19]

Oxley et al.

[11] Patent Number: 5,720,670

[45] Date of Patent: Feb. 24, 1998

[54] GOLF PRACTICE APPARATUS

[75] Inventors: Bruce J. Oxley; Gary A. Stegmeier; Paul R. Crawford, all of Calgary, Canada

[73] Assignee: Griffin Intellectual Property Development Corporation, Calgary, Canada

[21] Appl. No.: 646,299

[22] PCT Filed: Sep. 15, 1995

[86] PCT No.: PCT/CA95/00519

§ 371 Date: Jul. 26, 1996

§ 102(e) Date: Jul. 26, 1996

[87] PCT Pub. No.: WO96/08294

PCT Pub. Date: Mar. 21, 1996

[30] Foreign Application Priority Data

Sep. 16, 1994 [CA] Canada ..... 2132264

[51] Int. Cl.[6] ..... A63B 69/36

[52] U.S. Cl. ..... 473/279

[58] Field of Search ..... 473/279, 278, 473/161, DIG. 13; 428/17

[56] References Cited

U.S. PATENT DOCUMENTS 5,005,837 4/1991 Urra Martinez ..... 473/279

5,340,111 8/1994 Froelich ..... 473/279

FOREIGN PATENT DOCUMENTS 06190096 7/1994 Japan .

*Primary Examiner*—Mark S. Graham

*Attorney, Agent, or Firm*—Bennett Jones Verchere

[57] ABSTRACT

A golf practice platform is provided having a practice surface which can be tilted to simulate up hill, down hill and side hill shots by the action of a pair of screw drives and a pair of double acting hydraulic cylinders acting about a universal joint. A golf practice mat is also provided for use on the tilting platform or on other golf practise surfaces. The mat provides a means for varying the exposed height of the bristles to simulate grass conditions such as tee box, fairway and rough.

10 Claims, 3 Drawing Sheets

GOLF PRACTICE APPARATUS

FIELD OF THE INVENTION

This invention relates to a golf practice apparatus, and in particular, a platform and practice surface for use in practising golf shots.

BACKGROUND OF THE INVENTION

Golfers find it desirable to practise their strokes and shots. Generally such practise takes place at a driving range. The practice surface at a driving range is generally flat and does not resemble the variety of terrains and conditions encountered during play.

It is desirable that a practice surface simulate actual conditions which may be encountered during play, such as up hill, down hill and side hill shots. It is further desirable that the golfer can practise both his stroke and stance in the up hill, down hill or side hill position in any simulated shot. The practice surface should be adaptable to simulate various shots without moving heavy equipment or changing locations.

It is also desirable that other golf conditions be simulated, such as sand trap, variations in grass and variations in tee height.

To facilitate practise, it is desirable that a golf shot simulator be very easy to use, safe and very versatile.

SUMMARY OF THE INVENTION

The present invention provides a golf shot simulator which is easy to use, includes many safety features and is very versatile. Various golf game conditions can be simulated by use of the present invention.

In accordance with a broad aspect of the present invention, there is provided a golf practice mat comprising:

a mat having a plurality of bristles extending therefrom; and a practice surface having a plurality perforations extending therethrough, the mat being positioned with respect to the practice surface such that the bristles are capable of extending through the perforations and being exposed above the practice surface; and, means for adjusting the bristles exposed height above the practice surface.

In accordance with another broad aspect of the present invention there is provided a golf practice apparatus comprising:

a practice surface for supporting a golfer, a portion of the practice surface being perforated to accommodate a golf practice mat comprising a mat having a plurality of bristles extending therefrom; the mat being positioned with respect to the portion of perforated practice surface such that the bristles are capable of extending through the perforations and being exposed above the practice surface, and means for adjusting the bristles exposed height above the practice surface; and;

a means for tilting the practice surface.

In accordance with a further broad aspect of the present invention there is provided a golf practice apparatus comprising:

a practice surface for supporting a golfer; and, a means for tilting the practice surface comprising a universal joint acting between a base portion and the practice surface, a pair of driving means acting to drive the tilting of the platform and a pair of double acting hydraulic cylinders to lock the practice surface into tilting position.

DESCRIPTION OF THE INVENTION

The invention provides a golf shot simulator in the form of a platform for supporting a golfer to practise shots. The platform comprises a practice surface for supporting the golfer, support means for the practice surface and lifting means for varying the vertical elevation of the practice surface to tilt the surface from the horizontal plane. The practice surface can tilt in all directions to allow for up-hill, down-hill and left and right side-hill shots or a combination thereof.

The practice surface of the platform is generally planar and of a size to allow a golfer to take a position on the platform. The practice surface is formed of a material, such as a wood, resin or reinforced resin, to support the weight of the golfer.

In an embodiment of the invention, the practice surface is covered in a synthetic grass mat or rubber pad, as is known. Preferably, the practice surface is adapted to support a tee. The tee may be in the form of a removable tee which fits into a mounting hole on the platform or, alternatively, a permanently mounted tee. There can also be provided various surfaces which simulate conditions encountered during play. For example, sand trap conditions are provided by forming a depressed area for containing sand or the like. Tee box, fairway and rough conditions are provided by mats having synthetic grass of appropriate lengths. In a preferred embodiment, the simulated condition surfaces are provided on the platform to allow for use by left and right handed golfers. Preferably, protective covers are provided for placement over the simulated surfaces when not in use to prevent damage to the surfaces and also to prevent injury to the golfer by inadvertent stepping on the sometimes unstable simulated surfaces.

The practice surface of the platform is supported at a distance from the surface on which the platform is placed. Support is provided by any suitable support means such as a plurality of legs or a central support and base. To prevent the platform from tipping when in use, supporting means are preferably provided at or near the outer edges of the platform. Alternatively, large stabilizing base portions are provided on the support means.

The platform is capable of tilting to simulate game conditions by action of lifting means. The lifting means of the platform can act to vary the vertical elevation of the platform as well as to support the platform fully or partially. In this way, the platform will sometimes not require separate support means. Preferably, the lifting means act to vary the vertical elevation of the practice surface independently at separate points and thereby allow the practice surface to be tilted in all directions. Lifting means include one or more of any suitable means, for example, pneumatic cylinders, hydraulic cylinders or mechanical drives such as those incorporating screw arrangements. An embodiment includes a pair of lifting means able to tilt the practice surface about a generally central pivotal support. As will be appreciated, tilt can also be provided by other arrangements such as four lifting means positioned to support the practice surface of the platform. Preferably the platform is provided with means for locking the platform into a tilted position.

The lifting means are actuated and controlled by any suitable means which are provided on the practice surface such as, for example, mechanical actuators having platform mounted hand or foot control, or electrical actuators having platform mounted hand or foot control. Alternatively, a remote system is used to control the actuators. Preferably, any such actuation means will allow the actuation of the lifting means and adjustment of the platform while in position on the platform. Preferably, a microprocessor is provided to control the operation of the platform. The microprocessor can provide control for such features as an automatic actuation of the platform to return to level after use, safety functions such as preventing platform actuation if a safety switch is not depressed and managing additional features.

In the preferred embodiment, the platform is provided with side rails on the practice surface to prevent injury by falling. In addition, the outer edges of the practice surface are formed to have a warning effect. For example, a border of different material or raised portions that will indicate to the golfer that the edge of the platform has been reached. The outer edges of the platform can also be formed to accommodate structural features of the platform such as ball storage units.

To prevent injury by catching equipment or clothing in the moving parts around the lifting means, the platform is preferably provided with a protective covering which extends down from the practice surface to the supporting surface on which the platform is placed. Preferably, this covering is formed in a pleated arrangement to accommodate the changes in the vertical elevation of the platform. In addition, preferably side shields are provided on the platform to prevent sideways deflection of balls. Side shields can be permanently mounted on the platform or removably mounted in slots provided on the side edges of the platform. Alternatively, the covers for protection of the simulated surfaces can be adapted to act as side shields. Preferably, the covers are formed of a thermoplastic and preferably are thermoformed, impact-modified, UV resistant ABS.

For use on the practice surface of the platform or for other golf practice surfaces, a synthetic grass apparatus has been devised which provides a means for varying the synthetic grass height to thereby simulate variable grass heights. Such an apparatus can be used to simulate a variety of golf terrains including tee box, fairway and rough. The apparatus comprises a synthetic grass mat acted upon by mat height determining means.

The synthetic grass of the apparatus is provided by a mat having bristles of predetermined length mounted on a backing. The bristles are formed of material having suitable stiffness and durability such as for example nylon and are secured to the mat backing by suitable means such as by stapling, sewing or weaving. The length of the bristles extending from the mat are of a length suitable when in use to simulate rough conditions, i.e. about 5 and 15 cm and preferably 10 cm.

To support the mat in a stiff position, the backing of the mat is attached as by gluing to a stiff retaining material such as, for example, metal, wood, plastic or heavy paper board. Alternatively, a stiff retaining material can be fit between the bristles adjacent the mat backing. In another embodiment, the backing of the mat is formed from a stiff material such as, for example, sheet metal or plastic and the bristles are firmly secured thereto.

The height determining means acts to vary the length of the bristles exposed and extending out from the practice surface and comprises a perforated upper surface and a driving means. The perforated practice surface has formed therein a plurality of perforations. To allow for the variation in the length of the exposed bristles, the mat is placed below the perforated practice surface and the bristles are inserted through the perforations. The mat height is then varied by varying the distance between the mat and the practice surface to thereby increase or reduce the length of bristles exposed above the practice surface. The distance between the practice surface and the mat can be varied by driving either the mat or the practice surface or both. In the preferred embodiment, the practice surface remains stationary while the mat is driven to vary the exposed bristle height.

The driving action can be provided by any suitable means such as, for example, a manual lever, an electromechanically driven scissor linkage or screw drive.

The synthetic grass apparatus is actuated and controlled by any suitable means such as, for example, manual mechanical drives having hand or foot control, and electrical actuators hand or foot control. A remote system can also be used to control the lifting means.

In an embodiment, a perforated compactable layer, such as sponge or foam rubber, is provided between the practice surface and the mat backing. In an embodiment the compactable layer is formed of neoprene sheet laminated to 12 gauge cold rolled steel. The perforations of the compactable layer are aligned with the perforations of the practice surface and provide a channel through which the bristles of the mat can extend towards the practice surface. The compactable layer acts to maintain the bristles in an upright position and prevents the bristles from being caught under the practice surface. The compactible layer does not, however, prevent the movement of the mat and practice surface. The compactable layer material is selected to have excellent memory such that after compression it will expand to fill the space between the mat and the practice surface.

In another embodiment, the practice surface is covered with a resilient sheet having perforations which are aligned with the perforations of the practice surface. The resilient sheet acts to prevent damage of the practice surface during use and additionally prevents shearing of the bristles against the edges of the perforations of the practice surface.

In an embodiment, a mount for a tee or permanent tee is mounted on the resilient sheet or the practice surface of the synthetic grass apparatus. Alternatively, and more preferred, an opening is provided in the synthetic grass arrangement for an automatic tee device. Such a device permits the tee to be retracted below the practice surface when not in use. The device can also permit the exposed height of the tee to be varied when in use, thereby permitting the simulation of hill shots in which the golfer's feet are level with the ball.

To facilitate the use of the automatic tee, a ball loading device is preferably provided. The ball loading device acts to move a supply of balls through a loading chute to be loaded one ball at a time onto the cup of the tee. Any ball loading device which can act below the surface of the platform is suitable for use with the present invention.

BRIEF DESCRIPTION OF THE DRAWINGS

A further detailed description of the invention, briefly described above, will follow by reference to the following drawings of specific embodiments of the invention, which depict only typical embodiments of the invention and are therefore not to be considered limiting of its scope. In the drawings.

DETAILED DESCRIPTION OF THE PRESENT INVENTION

Figure 1:
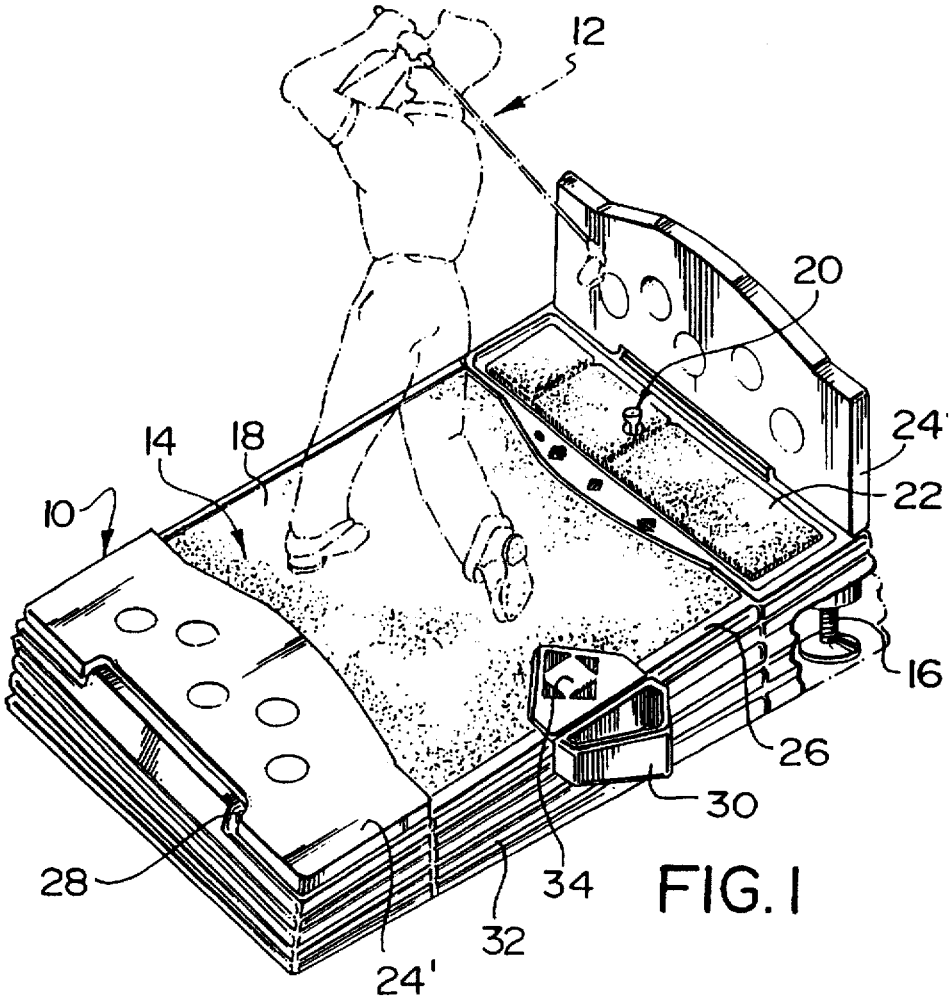
FIG. 1 shows a perspective, partially cut away view of an embodiment of a golf simulator platform of the present invention.

Referring to FIG. 1, a platform 10 is shown for supporting a golfer 12 while practising golf shots. The platform comprises a practice surface 14 and screw drive arrangement 16 at each corner of the platform for supporting and lifting the platform to cause the platform to tilt. (Only one of the screw drives is shown.)

Practice surface 14 is formed of fibre board and is covered on a portion of its upper surface with a rubber mat 18. A tee 20 is supported on the practice surface and is positioned on the surface to allow driving of a ball from the tee. Mat surfaces 22 are also provided on the practice surface which simulate various grass conditions.

Tee and mat surfaces are provided on both sides of the platform such that the platform can be used by left and right handed golfers. Protective covers 24, 24' are provided which can be placed to overlie the tee and mat surfaces when they are not in use, as shown by cover 24' on the left side of platform 10. When the tee and mat surfaces are in use, as shown at the right side of the platform, cover 24 can be moved into an upright position to act as a hand rail and a side shield to prevent sideways deflection of balls. Covers 24, 24' are moved into an upright position by rotation about pivotal connections 28 and are maintained in such position by releasable locks. In an embodiment, pivotal connections are provided by spring loaded hinge rods which snap the covers into position.

Mat 18 does not extend to cover the edges 26 of the platform to provide a warning to golfer 12 when the edge of the platform has been reached. Edges 26 of the platform are formed of thermoplastic, such as ABS, and accommodate structural features of the platform, such as pivotal connections 28 for protective covers 24, 24' and a ball hopper 30.

A protective covering 32 is provided about the platform to prevent injury by catching a user's clothing or the like in the mechanical systems, such as screw drives 16, disposed beneath practice surface 14. The protective covering is folded into an accordion arrangement to accommodate changes in the vertical elevation of the platform.

Platform 10 can be tilted, as shown, to simulate up-hill, down hill and side hill shots, by means such as screw drives 16 disposed beneath the practice surface. The screw drives are preferably controlled by controls 34 mounted on practice surface 14 which can be used by the golfer by touching with a foot or a club. The controls feed signals into a microprocessor, disposed beneath the platform which actuates and controls screw drives 16 to produce the desired tilt.

Figure 2A:
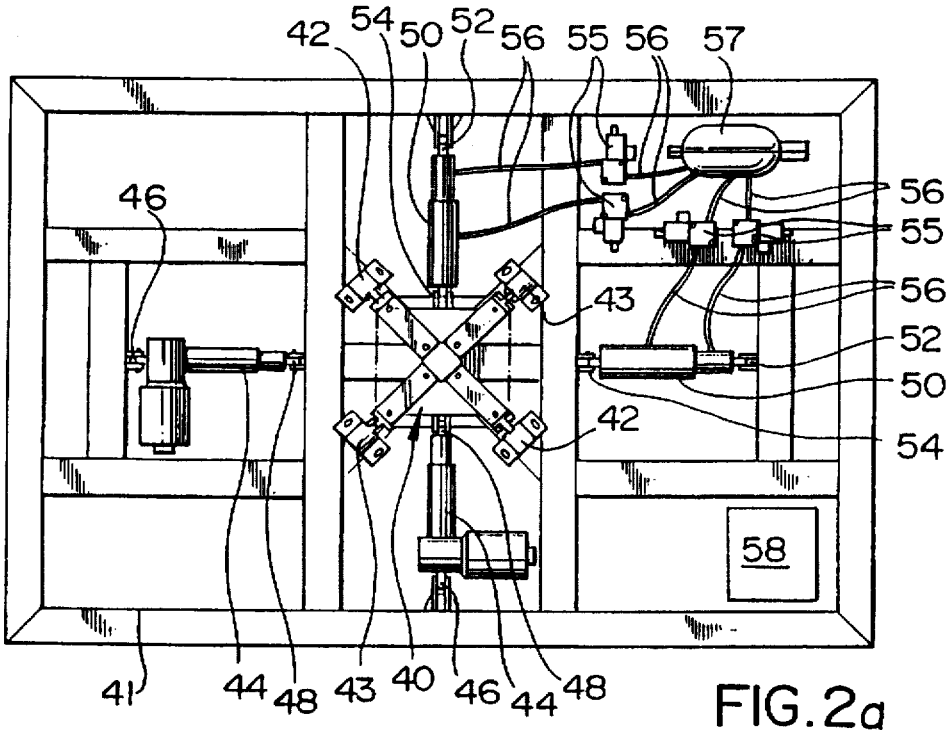
FIG. 2A shows a plan view of an alternate embodiment of a golf simulator platform of the present invention, with the practise surface removed.
Figure 2B:
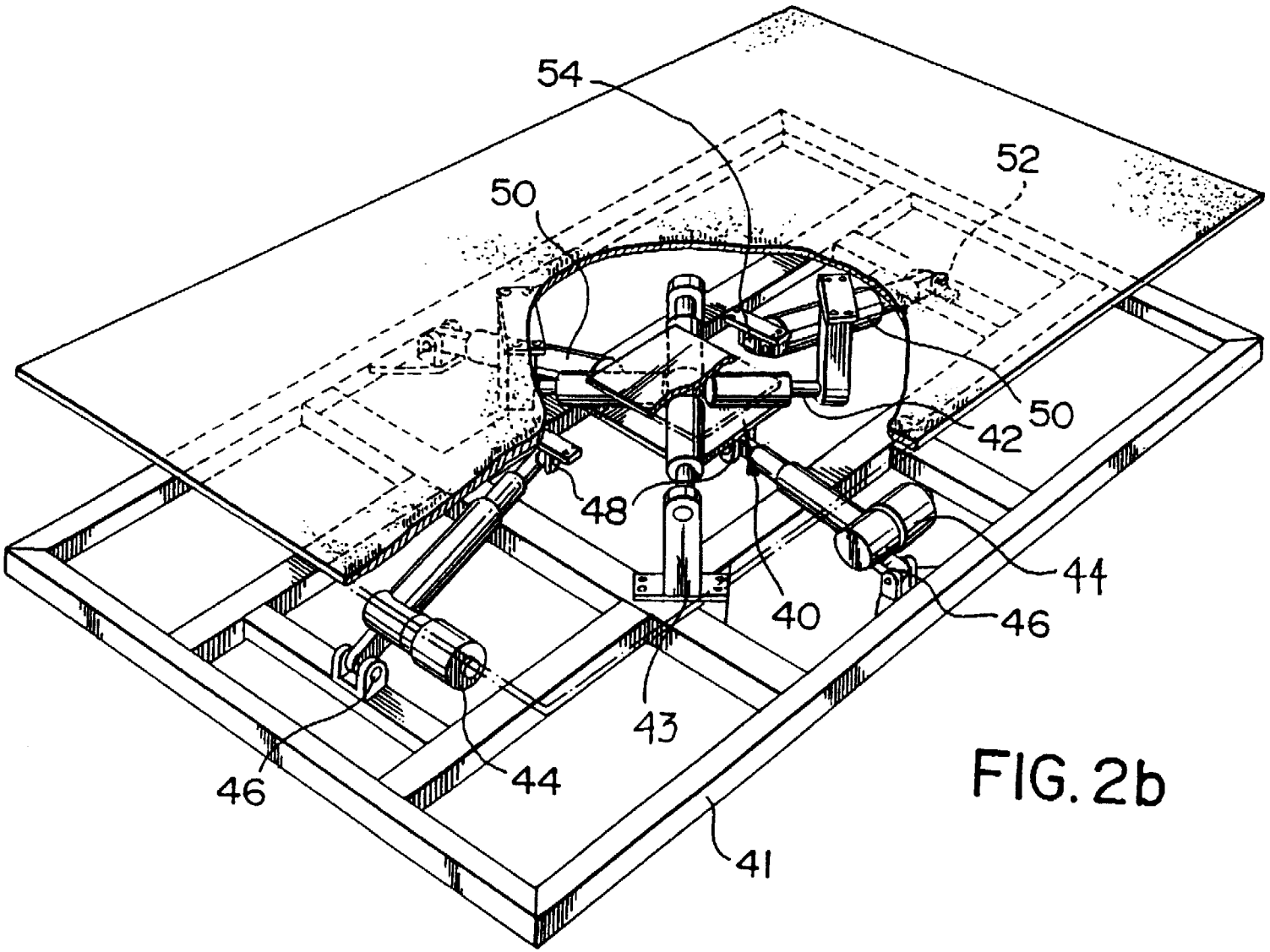
FIG. 2B shows a perspective view of the golf simulator platform of FIG. 2A, with the practise surface cut-away.

As shown in FIG. 2A and 2B, another embodiment of the platform is shown wherein the practice surface has been removed and cut-away, respectively, to show the tilting and support mechanism of the platform. A centrally positioned universal joint 40 acts to allow tilting of the practice surface, with respect to a base 41 about two axis as defined by pivotal connections 42, 43, respectively. A pair of electrically driven screw lifts 44 are attached by pivotal connections 46 and 48 to the base and practice surface, respectively, and drive the tilting of the practice surface as controlled by controls (not shown) on the practice surface. A pair of double acting hydraulic cylinders 50 are attached by pivotal connections 52, 54 between the base and practice surface, respectively, and act to lock the platform in tilted position and to prevent backlash when the screw lifts are activated or inactivated. Hydraulic cylinders 50 are caused to be locked or unlocked by control of four solenoid valves 55 which regulate the flow of hydraulic fluid via lines 56 between the chambers of hydraulic cylinders 50 and a reservoir 57. A microprocessor 58 coordinates the action of the screw lifts 44 and solenoids 55.

In use, when a suitable signal is fed to the microprocessor from the controls on the practise surface, the microprocessor actuates the screw lifts to drive the tilting of the practice surface. At the same time, the microprocessor actuates the solenoid valves which allow the hydraulic fluid to flow under pressure between the chambers of the hydraulic cylinders as the platform is tilted. When the controls on feed a signal to the microprocessor to cease the tilting of the practise surface, the microprocessor causes the solenoid valves to be disengaged, ceasing the flow of hydraulic fluid. After a short delay, the microprocessor actuates the screw drives to cease their driving action. Thus, any backlash in the universal joint, between the practise surface and base is substantially eliminated.

Figure 3:
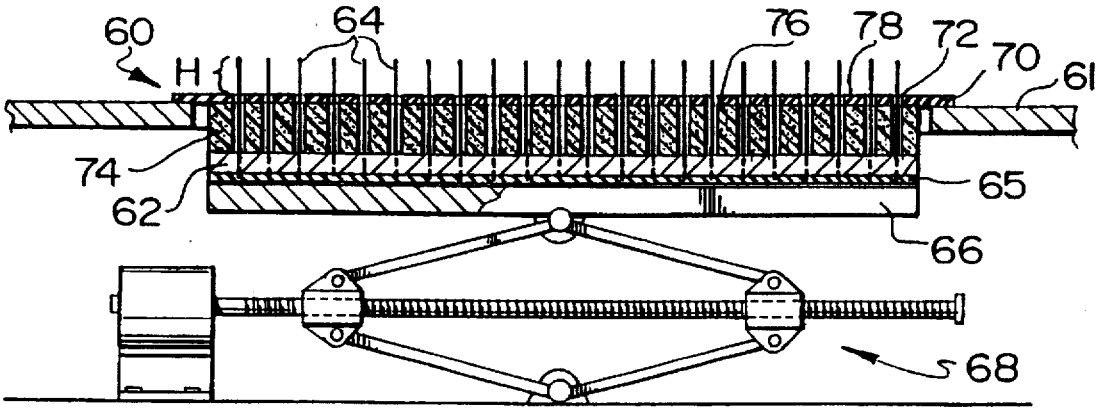
FIG. 3 shows a side sectional view of an embodiment of a synthetic grass apparatus of the present invention; and, FIG. 4 shows a perspective view of another embodiment of the invention having a synthetic grass apparatus mounted on a golf platform.

Referring to FIG. 3, a synthetic grass apparatus 60 is shown for use on golf practice surfaces 61 to simulate conditions such a tee box, fairway and rough. The apparatus of the preferred embodiment comprises a mat 62 having bristles 64 stapled to a rubber backing 65. Mat 62 is attached by means of adhesives to a stiff panel 66, formed of metal, which acts to support mat 62 in a planar position. Panel 66 is connected to a screw driven scissor lift 68 which acts to drive panel 66, and thereby mat 62, relative to a perforated practice surface 70. Lift 68 acts to move bristles 64 through the perforations 72 of the practice surface 70 to increase or decrease the height, indicated as H, of bristles exposed above practice surface 70.

To maintain the bristles in an upright position, compactable layer 74 is provided between mat backing 65 and practice surface 70. Compactable layer 74 formed of material such as neoprene has channels 76 through which bristles 64 can extend. In addition, to prevent damage to the practice surface and bristles by golf clubs, a perforated, rubber sheet 78 is placed over the practice surface and is aligned with the perforations 72 of practice surface 70.

Figure 4:
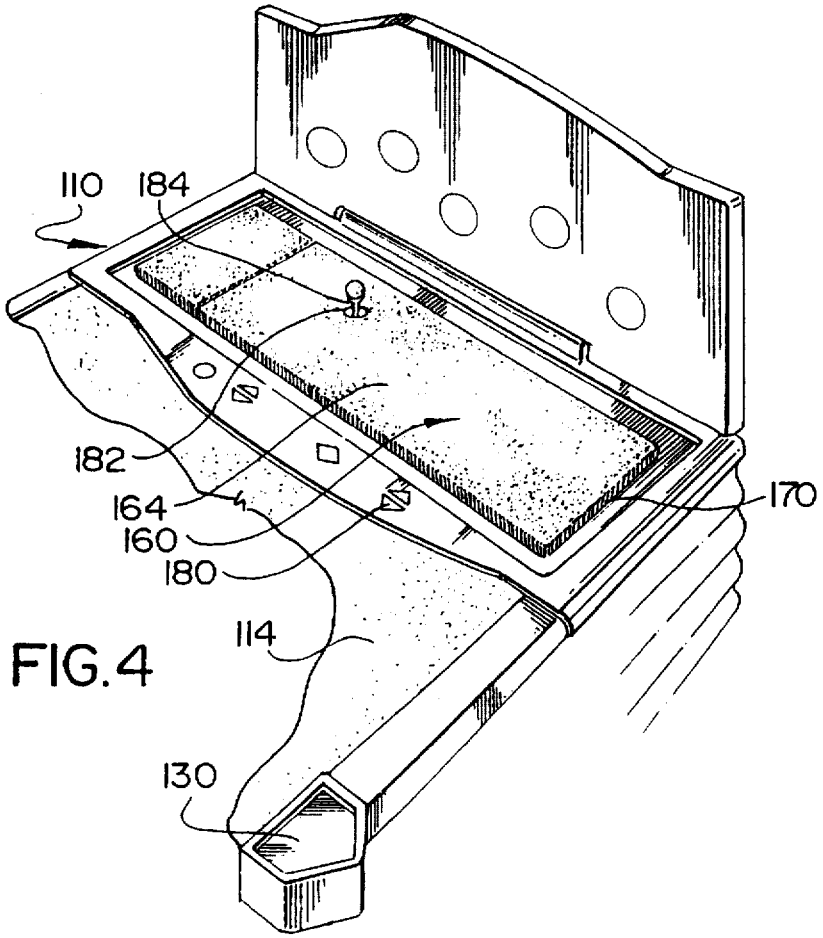

The synthetic grass apparatus can be of use with the platform of the present invention. As shown in FIG. 4, perforated practice surface 170 of synthetic grass apparatus 160 is mounted to be substantially co-planar with practice surface 114 of platform 110 and bristles 164 are exposed above surface 170. The mat height is controlled by foot pedals 180 mounted on the practice surface 114, which actuate the screw drive of the apparatus positioned below practice surfaces 114 and 170.

In an embodiment, an opening 182 is provided in the synthetic grass apparatus through which an automatic tee 184 extends. A device positioned below practice surface 170 drives the tee between an exposed position above practice surface 170, as shown, and a retracted position below surface 170. A ball loading device (not shown) positioned below practice surfaces 114 and 170 acts to load balls from ball hopper 130 to tee 184.

It will be apparent that many other changes may be made to the illustrative embodiments, while falling within the scope of the invention and it is intended that all such changes be covered by the claims appended hereto.

The embodiments of the invention in which an exclusive property or privilege is claimed are defined as follows:

1. A golf practice mat comprising:

a mat having a plurality of bristles extending therefrom; and a practice surface having a plurality perforations extending therethrough, the mat being positioned with respect to the practice surface such that the bristles are capable of extending through the perforations and being exposed above the practice surface;

means for adjusting the bristles exposed height above the practice surface; and a layer of compactable material disposed between the mat and the practice surface, the compactable material having channels therethrough through which the bristles extend.

2. The golf practice mat as claimed in claim 1 wherein the means for adjusting the bristles exposed height comprises a means for driving the mat with respect to the practice surface.

3. The golf practice mat as claimed in claim 1 wherein the means for adjusting the bristles exposed height comprises a means for driving the practice surface with respect to the mat.

4. The golf practice mat as claimed in claim 2 wherein the means for driving the mat is a screw driven scissor link.

5. The golf practice mat as claimed in claim 1 mounted on a golf practice platform.

6. The golf practice mat as claimed in claim 1 wherein the golf practice platform is tiltable.

7. A golf practice apparatus comprising:

a practice surface for supporting a golfer, a portion of the practice surface being perforated to accommodate a golf practice mat comprising a mat having a plurality of bristles extending therefrom;

the mat being positioned with respect to the portion of perforated practice surface such that the bristles are capable of extending through the perforations and being exposed above the practice surface, means for adjusting the bristles exposed height above the practice surface, and a layer of compactable material disposed between the mat and the practice surface, the compactable material having channels therethrough through which the bristles extend; and;

a means for tilting the practice surface.

8. The golf practise apparatus as claimed in claim 7 wherein the means for tilting the practice surface comprises a universal joint acting between a base portion and the practice surface, a pair of driving means acting to drive the tilting of the platform and a pair of double acting hydraulic cylinders to lock the practice surface into tilting position.

9. The golf practice apparatus as claimed in claim 8 wherein the universal joint is centrally located and the driving means and the hydraulic cylinders are spaced equally about universal joint and each hydraulic cylinder is positioned opposite a driving means.

10. The golf practice apparatus as claimed in claim 9 wherein the tilting of the platform is controlled by means of a microprocessor which acts to lock the cylinders just prior to inactivation of the driving means.

* * * * *